US008155567B2

(12) United States Patent
Sakuma

(10) Patent No.: US 8,155,567 B2
(45) Date of Patent: Apr. 10, 2012

(54) DEVELOPING DEVICE, PROCESS CARTRIDGE AND IMAGE FORMING APPARATUS

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 12/236,548

(22) Filed: Sep. 24, 2008

(65) Prior Publication Data

US 2009/0087225 A1 Apr. 2, 2009

(30) Foreign Application Priority Data

Sep. 28, 2007 (JP) ..... 2007-253848

(51) Int. Cl.
*G03G 15/08* (2006.01)
*G03G 21/00* (2006.01)

(52) U.S. Cl. ..... 399/262; 399/120; 399/254; 399/358

(58) Field of Classification Search ..... 399/120, 399/254, 255, 261, 358–360, 262
See application file for complete search history.

(56) References Cited

U.S. PATENT DOCUMENTS

| | | | | |
|---|---|---|---|---|
| 5,508,794 | A | 4/1996 | Ikesue et al. | |
| 5,510,881 | A | 4/1996 | Smith et al. | |
| 6,185,401 | B1 * | 2/2001 | Kanamori et al. | 399/262 |
| 6,445,899 | B2 | 9/2002 | Sato | |
| 6,510,300 | B2 * | 1/2003 | Mizoguchi et al. | 399/106 |
| 2005/0207794 | A1 * | 9/2005 | Katoh et al. | 399/254 |
| 2007/0025773 | A1 | 2/2007 | Tateyama et al. | |
| 2007/0048026 | A1 | 3/2007 | Tanabe | |
| 2007/0048027 | A1 * | 3/2007 | Park | 399/258 |
| 2007/0098448 | A1 | 5/2007 | Hart et al. | |
| 2007/0264053 | A1 | 11/2007 | Iwata et al. | |

FOREIGN PATENT DOCUMENTS

| | | |
|---|---|---|
| JP | 06-308829 | 11/1994 |
| JP | 08-054809 | 2/1996 |
| JP | 11-327269 | 11/1999 |
| JP | 2001-166556 | 6/2001 |
| JP | 2002-072686 | 3/2002 |

(Continued)

OTHER PUBLICATIONS

European Search Report, Application No. 08016406.4-2209, Reference 56/BR37M80/EP, Dtd Jan. 15, 2009.
Notification of Reason for Refusal for Japanese Application 2007-253848 mailed Aug. 4, 2009.

(Continued)

*Primary Examiner* — David Gray
*Assistant Examiner* — Joseph S Wong
(74) *Attorney, Agent, or Firm* — Banner & Witcoff, LTD

(57) ABSTRACT

A developing device includes a first conveying unit provided within a developing agent storage chamber and configured to convey developing agent from one end of the storage chamber to another end in a longitudinal direction of a developing agent carrier disposed within a developing chamber and to supply the developing agent from the storage chamber to the developing chamber. The device may include a second conveying unit provided within the developing chamber and configured to convey the developing agent from the other end of the developing chamber to the one end in the longitudinal direction and to supply the developing agent toward a developing agent carrier, and a third conveying unit provided between the one end of the storage chamber and the one end of the developing chamber and configured to convey the developing agent from the one end of the developing chamber to the one end of the storage chamber.

10 Claims, 9 Drawing Sheets

FOREIGN PATENT DOCUMENTS

| | | |
|---|---|---|
| JP | 2002-251070 | 9/2002 |
| JP | 2004-170651 | 6/2004 |
| JP | 2006-201474 | 8/2006 |
| JP | 2007-065390 | 3/2007 |

OTHER PUBLICATIONS

CN Office Action dtd Mar. 23, 2011 CN Appln. 200810169843.9, English translation.

* cited by examiner

DEVELOPING DEVICE, PROCESS CARTRIDGE AND IMAGE FORMING APPARATUS

CROSS REFERENCE TO RELATED APPLICATION

The present disclosure relates to the subject matter contained in Japanese patent application No. 2007-253848 filed on Sep. 28, 2007, which is expressly incorporated herein by reference in its entirety.

TECHNICAL FIELD

The present invention relates to a developing device, a process cartridge and an image forming apparatus.

BACKGROUND ART

An image forming apparatus for forming an image on a recording sheet includes a developing device for supplying a developing agent to a surface of a photosensitive element. The developing device is generally configured to have a developing agent storage chamber and a developing chamber that can communicate with each other via a supplying port. A developing agent supplying roller and a developing roller are accommodated in the developing chamber.

The image forming apparatus, in some cases, has to dispose the developing device therein such that the developing agent storage chamber is located above the developing chamber, as disclosed, for example, in JP-A-2001-166556. The image forming apparatus disclosed in JP-A-2001-166556 adopts a horizontal tandem-type image forming system in which plural photosensitive drums are aligned in a horizontal direction and in parallel to one another to form a color image on a recording sheet by developing agents. The horizontal tandem-type image forming system suffers from a problem in that the length becomes long in a direction in which plural photosensitive drums are aligned.

To solve this problem, the developing devices which correspond, respectively, to the photosensitive drums have to reduce their dimensions in the direction in which the photosensitive drums are aligned. To this end, the developing agent storage chamber, which is normally located adjacent to the developing chamber, is located above the developing chamber as disclosed in JP-A-2001-166556.

The developing device disclosed in JP-A-2001-166556 can use gravity to downwardly move the developing agent from the developing agent storage chamber to the developing chamber, thereby supplying the developing agent to the feeding roller and the developing roller.

However, since the developing agent is only moved downwardly from the developing agent storage chamber to the developing chamber in a one-way direction, repetition of development results in increase in a ratio of deteriorated developing agent in the developing chamber. In particular, by fresh developing agent being additionally supplied and forced into the developing chamber downwardly from the developing agent storage chamber, the deteriorated developing agent is accumulated at longitudinal end portions of the developing roller in the developing chamber. The accumulated developing agent is likely to lower the quality of an image considerably at both end portions of the image, in particular, when a color image is formed.

Not only the horizontal tandem-type color laser printer but also a monochrome laser printer suffers from the same problem when a developing agent storage chamber is located above a developing chamber.

Since the problem of deterioration of a developing agent is caused by subjecting the developing agent to sliding friction, the problem commonly can occur over developing devices in which a developing agent is charged through friction charging. In the event that the developing agent is deteriorated, phenomena such as a reduction in fluidity due to the embedment of externally added agents which are externally added to the developing agent and a reduction in charging quantity due to a reduction in charging function are generated. This phenomena may cause rough and scattered printing and in worst case, background fogging, on an image formed on a recording sheet.

When a fresh and non-deteriorated developing agent is added to the deteriorated developing agent whose charging function is reduced, a charging failure is caused in the deteriorated developing agent depending upon conditions, and this may cause a situation in which the background fogging is worsened.

SUMMARY

As an illustrative, non-limiting embodiment, the present invention provides a developing device which includes: a developing chamber in which a developing agent carrier is disposed, the developing chamber having one end and another end opposite to the one end in a longitudinal direction of the developing agent carrier; a developing agent storage chamber disposed above the developing chamber in a gravity direction, the developing agent storage chamber having one end and another end opposite to the one end of the developing agent storage chamber in the longitudinal direction; a partition wall partitioning the developing chamber and the developing agent storage chamber; a developing agent carrier disposed within the developing chamber; a first conveying unit that is provided within the developing agent storage chamber and that is configured to convey a developing agent from the one end of the developing agent storage chamber to the other end of the developing agent storage chamber and to supply the developing agent from the developing agent storage chamber to the developing chamber; a second conveying unit that is provided within the developing chamber and that is configured to convey the developing agent from the other end of the developing chamber to the one end of the developing chamber and to supply the developing agent toward the developing agent carrier; and a third conveying unit that is provided between the one end of the developing agent storage chamber and the one end of the developing chamber and that is configured to convey the developing agent from the one end of the developing chamber to the one end of the developing agent storage chamber.

As another illustrative, non-limiting embodiment, the present invention provides a process cartridge which includes: the developing device as discussed above; and a photosensitive element on which a developing agent image is formed by the developing agent supplied from the developing agent carrier.

As another illustrative, non-limiting embodiment, the present invention provides a tandem-type image forming apparatus including: plural developing devices, each of which is configured as discussed above, wherein the plural developing devices are aligned in a conveying direction of a recording sheet on which an image is to be formed.

Accordingly, as one of advantages, the present invention can provide a developing device for an image forming apparatus, which can suppress defects generated by accumulation of a deteriorated developing agent within a developing chamber even when a developing agent storage chamber is disposed above the developing chamber. As another one of the advantages, the present invention can provide a process cartridge which can improve the quality of a developing agent image formed on a photosensitive element. As another one of the advantages, the present invention can provide a tandem-type image forming apparatus which can improve the quality of an image formed on a recording sheet and which can suppress the length in a direction in which the photosensitive elements are aligned.

These and other advantages of the present invention will be discussed in detail with reference to illustrative, non-limiting embodiments.

DESCRIPTION OF THE PREFERRED EMBODIMENT

Figure 1:
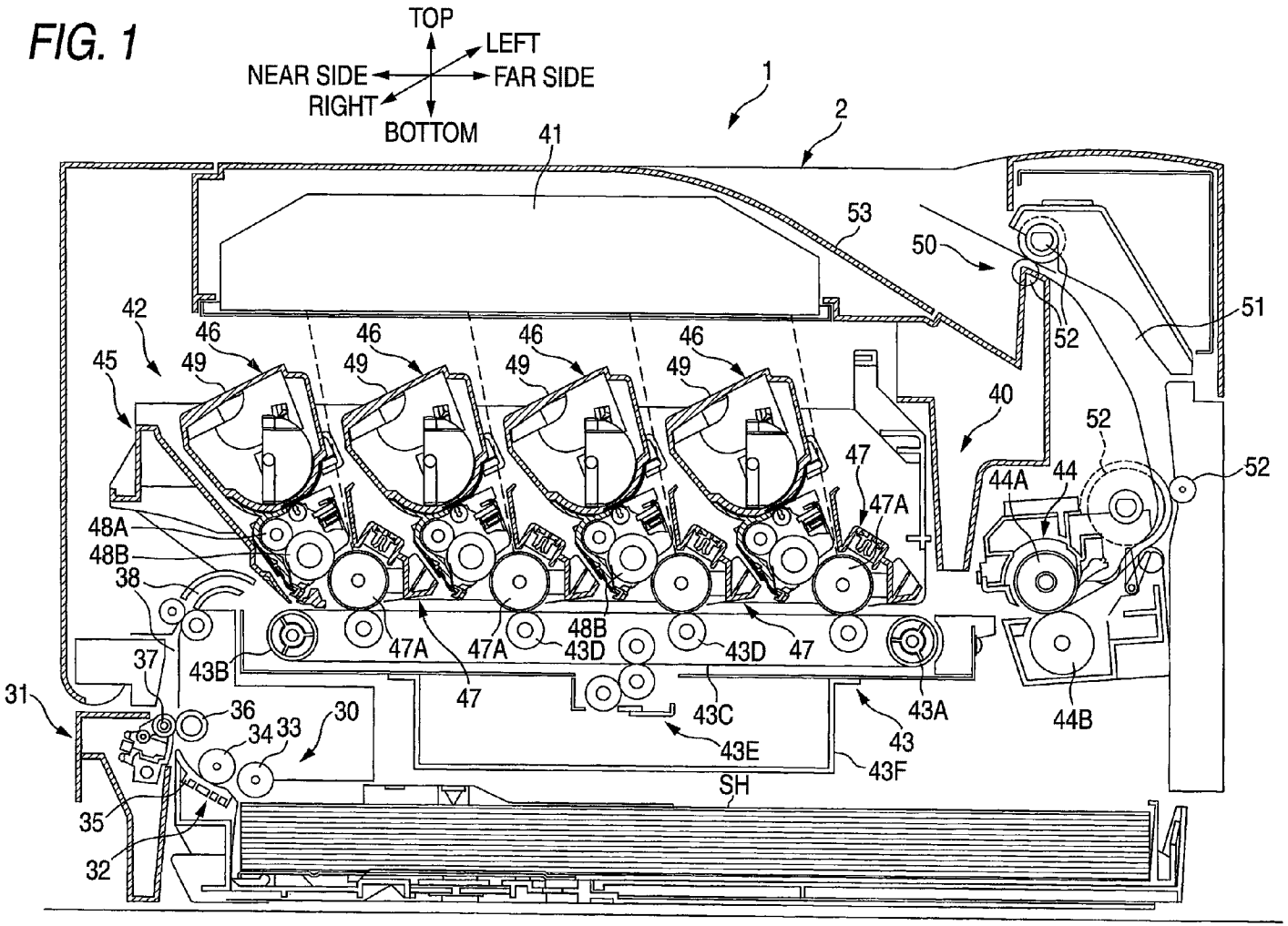
FIG. 1 is a longitudinal sectional view showing an overall configuration of a color laser printer which is an example of an image forming apparatus according to an embodiment.

Hereinafter, referring to the drawings, best modes of a developing device, a process cartridge and a tandem-type image forming apparatus according to the invention will be described. Note that in the following description, first of all, an overall configuration of a color laser printer as a tandem-type image forming apparatus according to an embodiment of the invention will be described based on FIG. 1, and thereafter, a developing device according to an embodiment of the invention which is incorporated in the color laser printer will be described in detail.

<Overall Configuration of Color Laser Printer>

As is shown in FIG. 1, a color laser printer 1, which is an example of a tandem-type image forming apparatus according the embodiment of the invention, includes a sheet feeding unit 30 for feeding recording sheets SH into a main body 2, an image forming unit 40 for forming an image on the recording sheet SH fed from the sheet feeding unit 30, and a sheet discharging unit 50 for discharging the recording sheet SH, on which the image has been formed by the image forming unit 40, from the main body 2.

In addition, top, bottom, left, right, near side and far side directions indicated by arrows in FIG. 1 denote directions oriented as viewed by a person standing on a near side of the color laser printer 1, and in the following description, unless mentioned otherwise, it is understood that top, bottom, left, right, near side and far side directions should follow the directions indicated by the arrows in FIG. 1.

<Configuration of Sheet Feeding Unit 30>

The sheet feeding unit 30 includes in a lower portion in the main body 2 a sheet feeding tray 31 which is detachably attached to the main body 2, and a sheet feeding mechanism 32 for conveying recording sheets SH from the sheet feeding tray 31 to the image forming unit 40.

The sheet feeding mechanism 32 has a sheet feeding roller 33, a separation roller 34, a separation pad 35 and the like, which are provided at a near side end portion of the sheet feeding tray 31 to separate and convey recording sheets SH one by one upwards. Paper dust on a recording sheet SH conveyed upwards is removed while the recording sheet SH is passing between a paper dust removing roller 36 and a pinch roller 37, and thereafter, the recording sheet SH passes along a conveying path 38 and is redirected to a far side, so as to be fed to the image forming portion 40.

<Configuration of Image Forming Unit 40>

The image forming unit 40 includes a scanner unit 41, a process unit 42, a transfer unit 43 and a fixing unit 44.

The scanner unit 41 is provided in an upper portion in the main body 2, and although not shown, the scanner unit 41 includes a laser emitting unit, a polygon mirror, and plural lenses and mirrors. In the scanner unit 41, laser beams emitted from the laser emitting unit to correspond to colors such as cyan, magenta, yellow and black are scanned laterally by the polygon mirror at high speeds, and after having been caused to pass or be reflected on the plural lenses and mirrors, the laser beams are irradiated onto photosensitive drums (photosensitive elements) 47A of the process unit 42.

<Configuration of Process Unit 42>

The process unit 42 includes a photosensitive unit 45 which is disposed between the scanner unit 41 and the transfer unit 43 and is detachably attached to the main body 2, and in this photosensitive unit 45, four (plural) process cartridges 46 which correspond, respective, to colors such as cyan, magenta, yellow and black are aligned in a tandem fashion in a direction in which the recording sheet SH is conveyed.

<Configuration of Process Cartridge 46>

The process cartridges 46 are aligned in the tandem fashion in a posture in which an upper portion is slightly tilted towards the near side. The process cartridge 46 includes a drum sub-unit 47 disposed in a lower portion, a developing agent cartridge 49 disposed in an upper portion and a developing unit 48 disposed between the drum sub-unit 47 and the developing agent cartridge 49. Side portions of the drum sub-unit 47 are detachably attached to a lower portion of the developing unit 48, and a lower portion of the developing agent cartridge 49 is detachably attached to an upper portion of the developing unit 48.

The drum sub-unit 47 includes a photosensitive drum 47A, which serves as a photosensitive element, and a scrotron-type charging unit (whose reference numeral is omitted). The developing unit 48 includes a supplying roller 48A, which serves as a developing agent supplying member, and a developing roller 48B, which serves as a developing agent carrier. The developing agent cartridge 49 stores therein a respective one of non-magnetic single-component toners (whose reference numerals are omitted) of cyan, magenta, yellow and black which are examples of developing agents.

The process unit 42 mainly made up of the process cartridges 46 functions as follows: A surface of the photosensitive drum 47A is positively charged by the scrotron-type charging unit of the drum sub-unit 47. This charged portion is exposed by a laser beam emitted from the scanner unit 41 so that the potential of the charged portion is decreased. By this way, an electrostatic latent image based on image data is formed on the photosensitive drum 47A. Further, the toner charged positively by the developing roller 48B is supplied to the electrostatic latent image to form toner image carried on the photosensitive drum 47A.

<Configuration of Transfer Unit 43>

The transfer unit 43 includes a drive roller 43A, a driven roller 43B, a conveyer belt 43C, transfer rollers 43D and a cleaning unit 43E.

The drive roller 43A and the driven roller 43B are disposed in parallel while being spaced apart from each other in the conveying direction of the sheet SH. The endless conveyer belt 43C is suspended between the drive roller 43A and the driven roller 43B. The conveyer belt 43C is driven to rotate together with the driven roller 43B when the drive roller 43A is driven to rotate.

The transfer rollers 43D are disposed inside of the conveyer belt 43C in such a manner that the conveyer belt 43C is interposed between each of the transfer rollers 43D and a corresponding one of the photosensitive drums 47A. A transfer bias is applied to the transfer roller 43D from a high-voltage circuit board, not shown. When an image is formed on the recording sheet SH conveyed by the conveyer belt 43C, the recording sheet SH and the conveyer belt 43C are nipped between the photosensitive drum 47A and the transfer roller 43D so that the recording sheets SH is pressed onto the photosensitive drum 47A. In this way, the toner image on the photosensitive drum 47A is transferred onto the recording sheet SH.

The cleaning unit 43E is disposed below the conveyer belt 43C to remove the toner sticking to the conveyer belt 43C. The removed toner falls into a toner reservoir unit 43F disposed below the cleaning unit 43E.

<Configuration of Fixing Unit 44>

The fixing unit 44 is disposed on a downstream side of the transfer unit 43, that is, on a far side of the main body 2 and includes a heating roller 44A and a pressure roller 44B. A halogen lamp is provided in an interior of the heating roller 44A, and this halogen lamp heats up a surface of the heating roller 44A to a fixing temperature. The pressure roller 44B is disposed to be in pressure-contact with the heating roller 44A. The pressure roller 44B feeds out the recording sheet SH while nipping the recording sheet SH between the heating roller 44A and the pressure roller 44B, thereby thermally fixing the toner image transferred on to the recording sheet SH.

<Configuration of Sheet Discharging Unit 50>

The sheet discharging unit 50 forms a sheet discharging side conveyer path 51 for recording sheets SH in such a manner as to extend upwards from an exit of the fixing unit 44 and to then be reversed towards the near side. Plural conveyer rollers 52 for conveying recording sheets SH are disposed in intermediate positions along the length of the sheet discharging side conveyer path 51. A sheet discharging tray 53 is provided by forming an appropriate depression on an upper surface of the main body. The sheet discharging tray 53 can stack thereon recording sheets SH discharged from the sheet discharging side conveyer path 51 by the conveyer rollers 52.

<Configuration of Developing Device>

Figure 2:
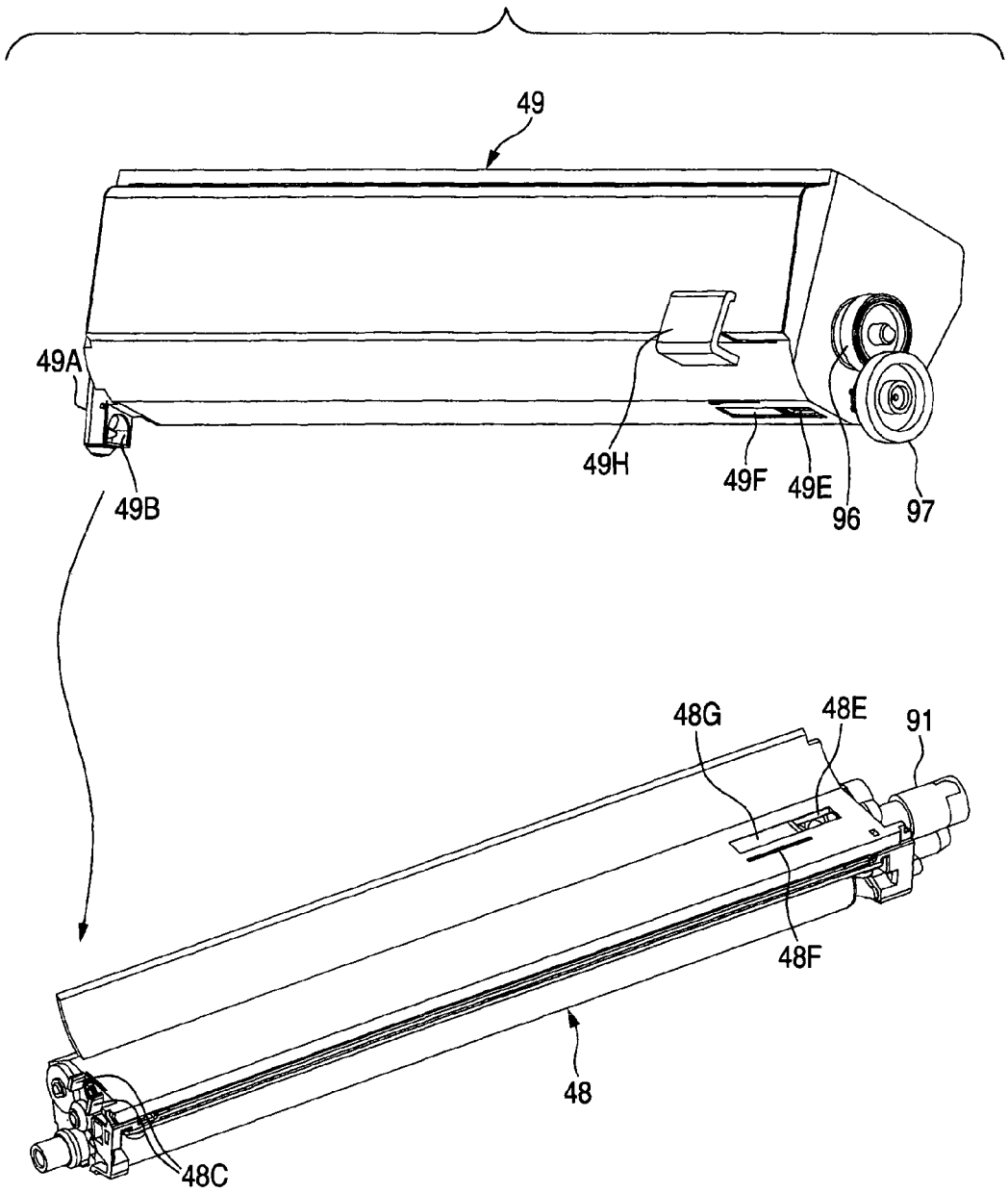
FIG. 2 is an exploded perspective view showing a developing agent cartridge and a developing unit shown in FIG. 1 which make up a developing device according to the embodiment.
Figure 3:
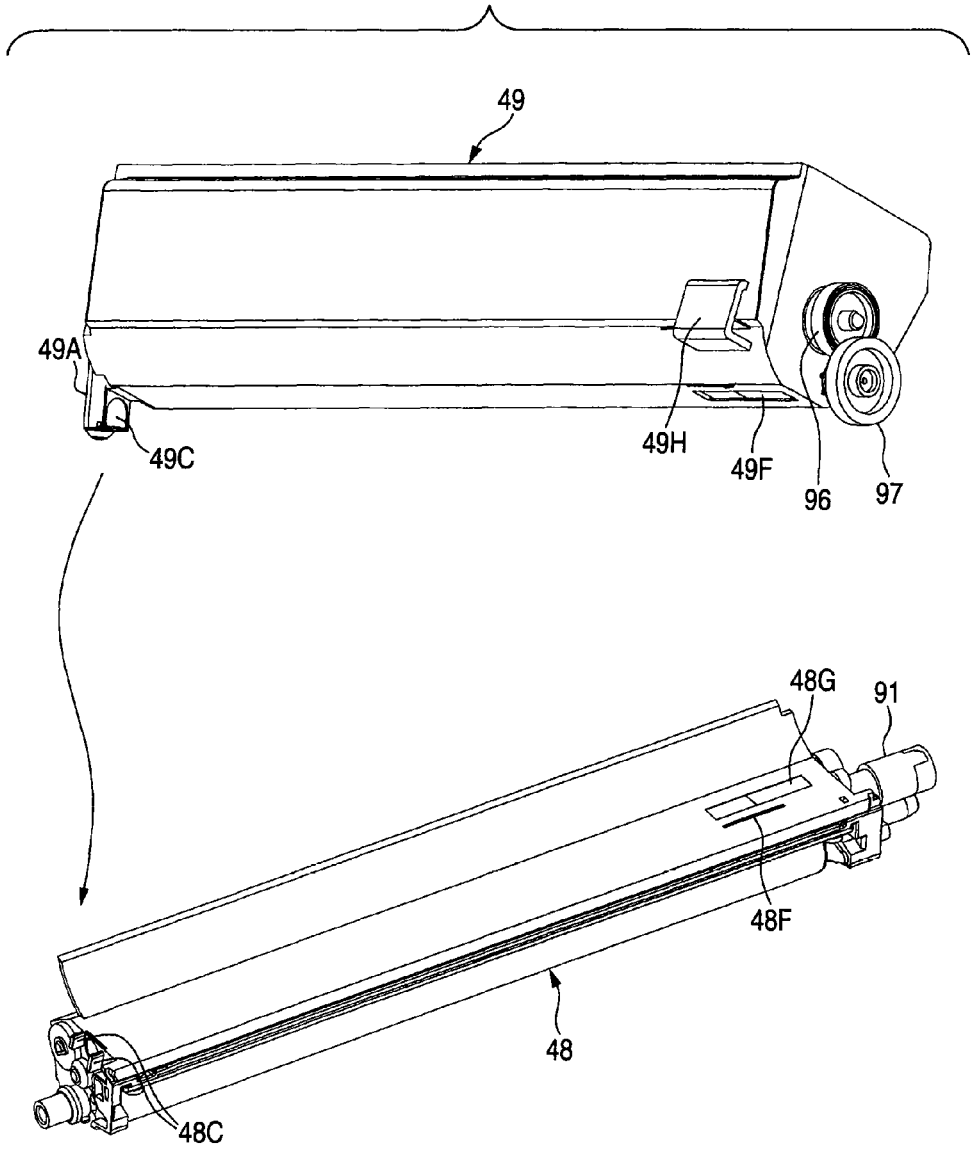
FIG. 3 is an exploded perspective view of the developing cartridge and the developing unit which corresponds to FIG. 2, the exploded perspective view showing a state in which shutters are closed.

FIGS. 2 and 3 show external appearances of the developing unit 48 and the developing agent cartridge 49 which are included in the process cartridge 46. The developing unit 48 defines a developing chamber, and the developing agent cartridge 49 defines a developing agent storage chamber. The developing unit 48 and the developing agent cartridge 49 form a developing device in this embodiment.

<Attaching and Detaching Construction of Developing Device>

The developing agent cartridge 49 has a communication cylindrical portion 49A projecting downwardly at one end portion, in a longitudinal direction, of the developing agent cartridge 49, that is, at one end portion, in a width direction, of the developing agent storage chamber which lies on the right-hand side indicated by the arrow in FIG. 1. The communication cylindrical portion 49A can be detachably attached to one end portion of the developing unit 48 so that one end portion of the developing agent cartridge 49 communicates with one end portion of the developing unit 48. Correspondingly, the developing unit 48 has a pair of front and rear receiving pieces 48C, 48C at one end portion, in a longitudinal direction, of the developing unit 48 (one end portion, in a width direction, of the developing chamber). The lower end portion of the communication cylindrical portion 49A can be detachably fitted between the front and rear receiving pieces 48C, 48C.

<Communicating Construction of Developing Device>

Figure 4:
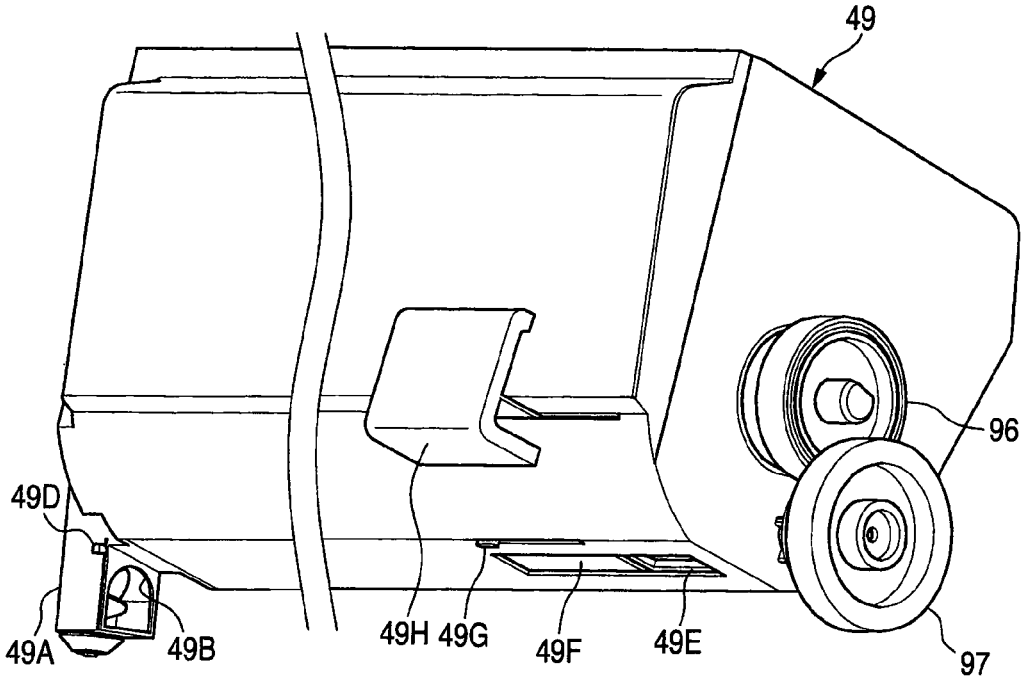
FIG. 4(*a*) is an exploded perspective view showing in an enlarged fashion a main part of the developing agent cartridge shown in FIG. 2, and FIG. 4(*b*) is an exploded perspective view showing in an enlarged fashion the developing unit shown in FIG. 2.
Figure 4:
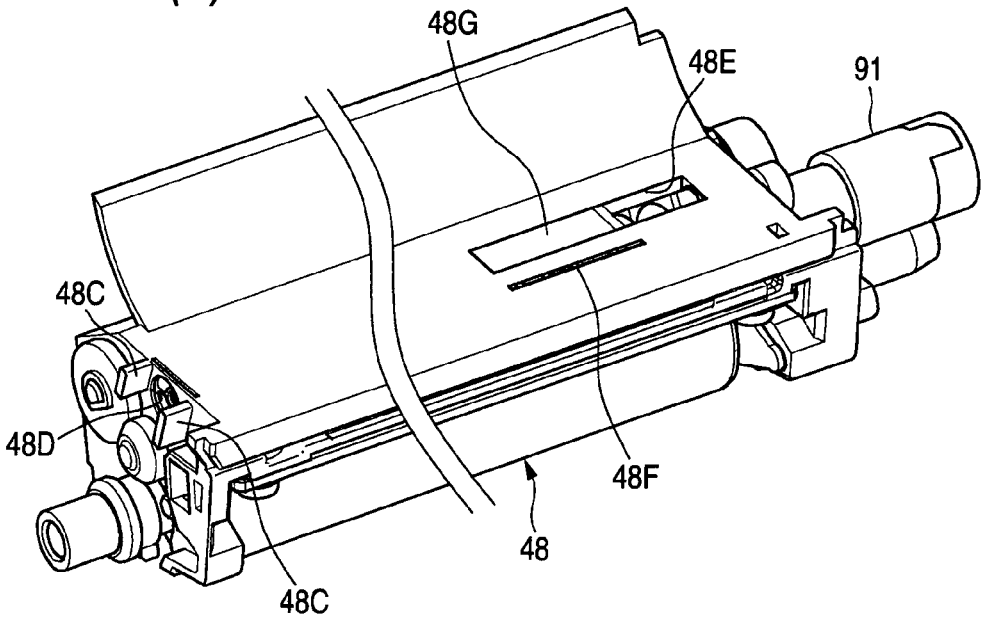

As shown in an enlarged fashion in FIGS. 4(*a*), 4(*b*), the one end portion of the developing unit 48 has a communication hole 48D, which is open between the pair of receiving pieces 48C, 48C. Correspondingly, a lower portion of the communication cylindrical portion 49A of the developing cartridge 49 has a communication hole 49B that is located in an inside surface in a width direction and that can confront the communication hole 48D for connection therewith.

Figure 5:
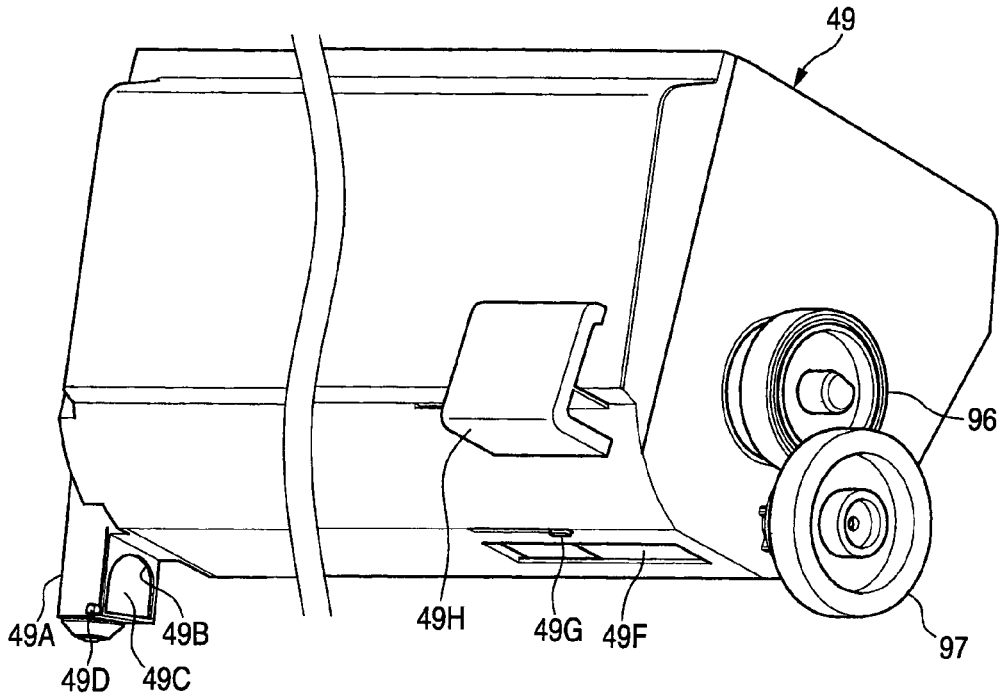
FIG. 5(*a*) is an exploded perspective view showing in an enlarged fashion a main part of the developing agent cartridge shown in FIG. 3, and FIG. 5(*b*) is an exploded perspective view showing in an enlarged fashion the developing unit shown in FIG. 3.
Figure 5:
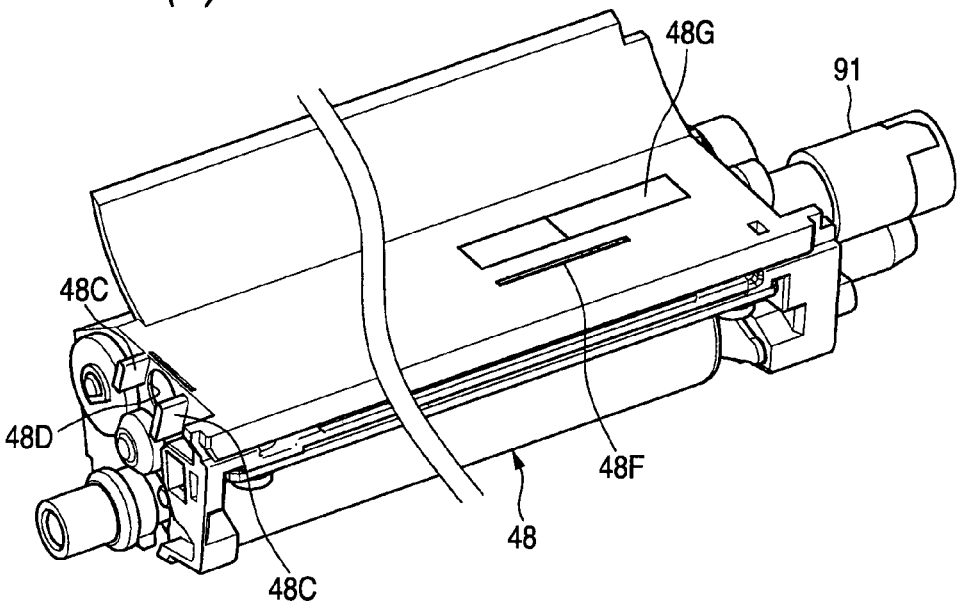

As shown in an enlarged fashion in FIG. 5(*a*), a shutter piece 49C is built in a lower end portion of the communication cylindrical portion 49A to be slidable vertically. An engagement projection 49D is formed integrally on the shutter piece 49C and projects from a side wall portion of the communication cylindrical portion 49A to the near side. The engagement projection 49D is brought into engagement with and pushed upwardly by an upper end portion of one of the receiving pieces 48C of the developing unit 48 so that the shutter 49C is slid upwards, whereby the communication hole 49B of the communication cylindrical portion 49A is opened (see FIG. 4(*a*)).

As shown in an enlarged fashion in FIG. 4(*a*), the developing agent cartridge 49 has a communication hole 49E at another end portion which is opposite to the one end portion in the longitudinal direction. The communication hole 49E is open at a lower surface of the developing agent cartridge 49. A shutter piece 49F is built in the other end portion of the developing agent cartridge 49 and slidable laterally. The shutter piece 49F can open and close the communication hole 49E.

The shutter 49F is integrally formed with an engagement projection 49G and an operation knob 49H. The engagement projection 49G projects from the lower surface of the other end portion of the developing cartridge 49. An operation knob 49H projects toward a near side from the other end portion of the developing cartridge 49. When the operation knob 49H is operated in the right-hand direction as shown in FIG. 5, the shutter piece 49F slides together with the engagement projection 49G to the right, whereby the communication hole 49E is closed.

As shown in an enlarged fashion in FIG. 4(*b*), the developing unit 48 has a communication hole 48E, which can confront the communication hole 49E of the developing agent cartridge 49 for connection therewith. The developing unit 48 further has a slit 48F, into which the engagement projection 49G of the developing agent cartridge 49 can be inserted. The communication hole 48E and the slit 48F are formed on an upper surface of another end portion of the developing unit 48 which is opposite to the one end portion of the developing unit 48 in the longitudinal direction. A shutter piece 48G is built in the other end portion of the developing unit 48 and slidable laterally. The shutter piece 48G can open and close the communication hole 48E.

An engagement recessed portion (whose illustration is omitted) is formed on the shutter piece 48G to be located below the slit 48F and to face the slit 48F. When the engagement projection 49G of the developing agent cartridge 49 is inserted into the slit 48F of the developing unit 48, the engagement projection 49F can be engaged with the engagement recessed portion of the shutter piece 48G. Accordingly, when the operation knob 49H of the developing agent cartridge 49 is operated in the right-hand direction as shown in FIG. 5(*a*), the shutter piece 48G slides to the right in conjunction with the engagement projection 49G, whereby the communication hole 48E of the developing unit 48 is also closed.

<Interior Construction of Developing Device>

Figure 6:
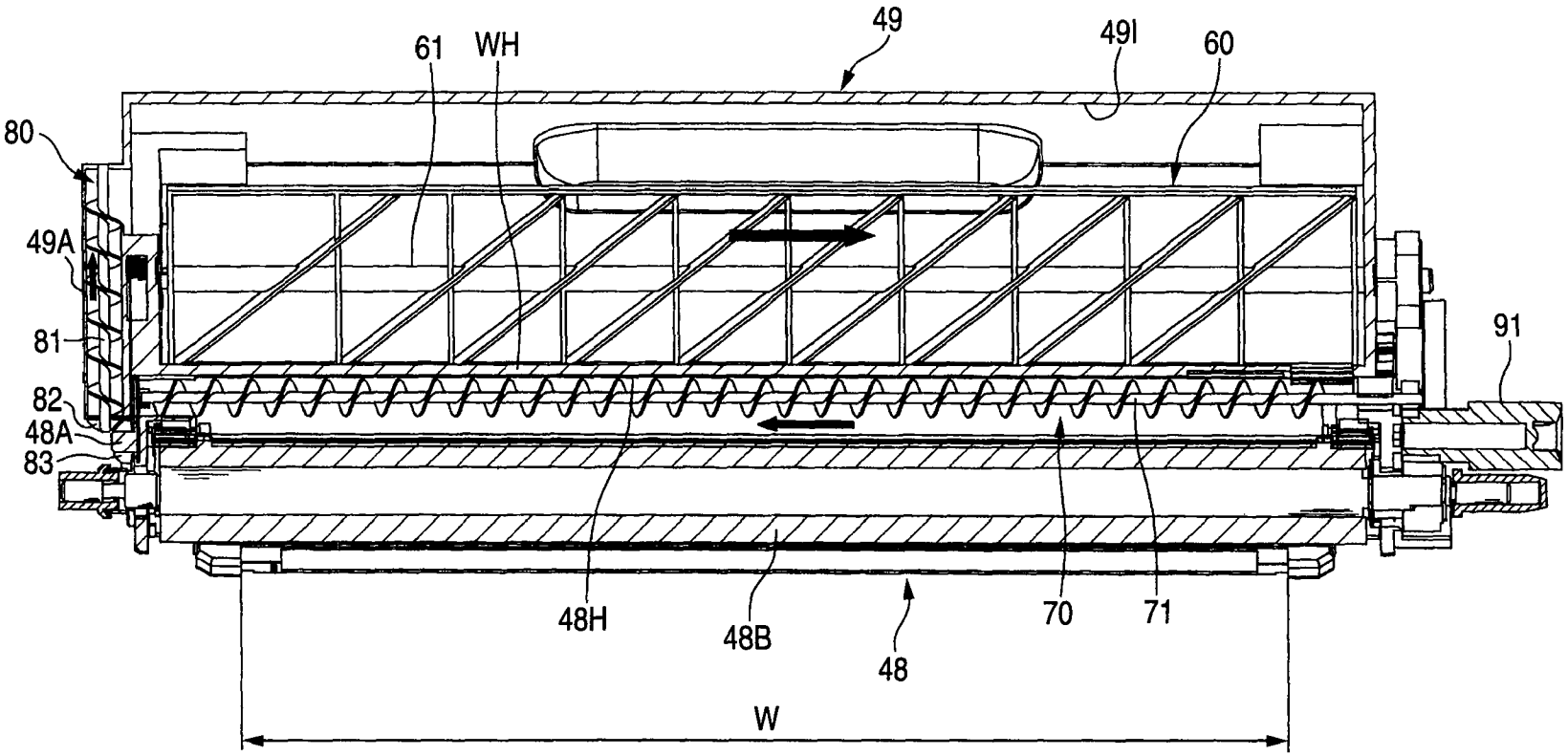
FIG. 6 is a longitudinal sectional view showing an interior construction of the developing device made up of the developing agent cartridge and the developing unit which are shown in FIG. 2.

As shown in FIG. 6, a developing chamber 48H in the developing unit 48 and a developing agent storage chamber 49I in the developing agent cartridge 49 are partitioned by a partition wall WH. One end portions, in the width direction, of the chambers 48H, 49I communicate with each other via the communication hole 48D of the developing unit 48 shown in FIG. 4(*b*) and the communication hole 49B of the developing agent cartridge 49 shown in FIG. 4(*a*). The other end portions, in the width direction, of the chambers 48H, 49I communicate with each other via the communication hole 48E of the developing unit 48 shown in FIG. 4(*b*) and the communication hole 49E of the developing agent cartridge 49 shown in FIG. 4(*a*).

<Configuration of First Conveying Unit>

An agitator 60, which can serve as a first conveying unit, is provided in the developing agent storage chamber 49I of the developing agent cartridge 49. This agitator 60 is driven to rotate about a rotational shaft 61 so as not only to convey the developing agent from the one end toward the other end of the developing agent storage chamber 49I while agitating the developing agent but also to supply the developing agent from the developing agent storage chamber 49I into the developing chamber 48H through the communication hole 49E and the communication hole 48E which are shown in FIGS. 4(*a*), 4(*b*), respectively.

<Configuration of Second Conveying Unit]

An auger 70, which can serve as a second conveying unit, is provided in the developing chamber 48H of the developing unit 48. This auger 70 is disposed above the developing roller 48B to extend horizontally along the partition wall WH. One end portion of the auger 70 faces the communication hole 48D shown in FIG. 4(*b*). When the auger 70 is driven to rotate about a rotational shaft 71. the auger 70 conveys the developing agent from the other end of the developing chamber 48H toward the communication hole 48D located in the one end of the developing chamber 48H.

<Configuration of Third Conveying Unit>

An auger 80, which can serve as a third conveying unit, is provided in the communication cylindrical portion 49A which is disposed in the one end of the developing agent storage chamber 49I of the developing agent cartridge 49 and which is located outside an image forming width (W in FIG. 6) specified within the developing chamber 48H of the developing unit 48. This auger 80 extends in a vertical direction perpendicular to an axial direction of the supply roller 48A (see FIG. 1). A lower end portion of the auger 80 faces the communication hole 49B shown in FIG. 4(*a*).

When the auger 80 is driven to rotate about a rotational shaft 81, the auger 80 conveys the developing agent from the one end of the developing chamber 48H to the one end of the developing agent storage chamber 49I. That is, the auger 80 upwardly moves the developing agent from the developing chamber 48H to the developing agent storage chamber 49I for recovery such that the auger 80 takes in the developing agent, conveyed by the auger 70 towards the communication hole 48D located at the one end of the developing chamber 48H, from the communication hole 49B and then conveys the developing agent thus taken in to an upper portion at the one end of the developing agent storage chamber 49I.

Figure 7:
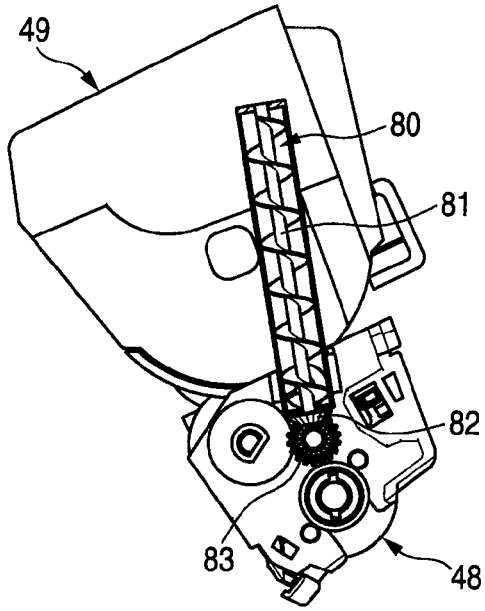
FIG. 7(*a*) is a side view of one ends of the developing agent cartridge and the developing unit which are shown in FIG. 6, and FIG. 7(*b*) is a partially enlarged sectional view of the one ends.
Figure 7:
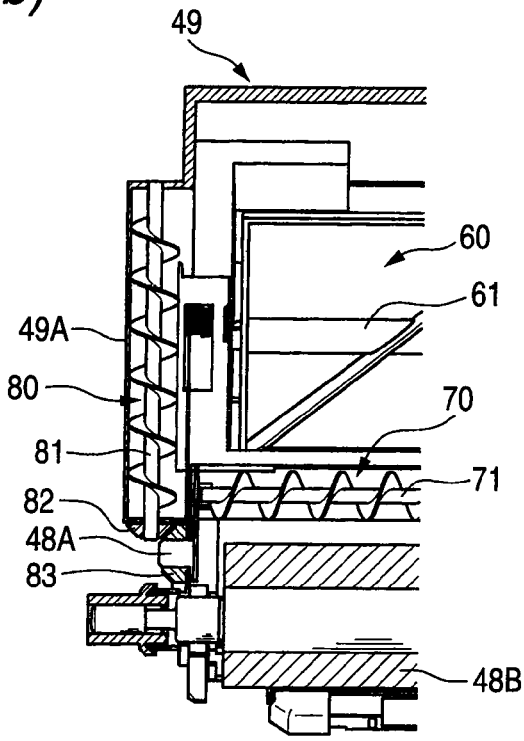

As shown in FIGS. 7(*a*), 7(*b*), a mechanism for driving the auger 80 to rotate while being linked with the rotation of the supplying roller 48A is provided on a side portion at the one end of the developing unit 48. Namely, a lower end portion of the rotational shaft 81 of the auger 80 projects from a lower end portion of the communication cylindrical portion 49A, and a driven bevel gear 82 is fixed to the projecting portion of the rotational shaft 81. A drive bevel gear 83 which meshes with the driven bevel gear 82 is fixed to one end portion of the supplying roller 48A which projects from the side portion at the one end of the developing unit 48.

<Configuration of Rotational Drive Transmission Mechanism>

Figure 8:
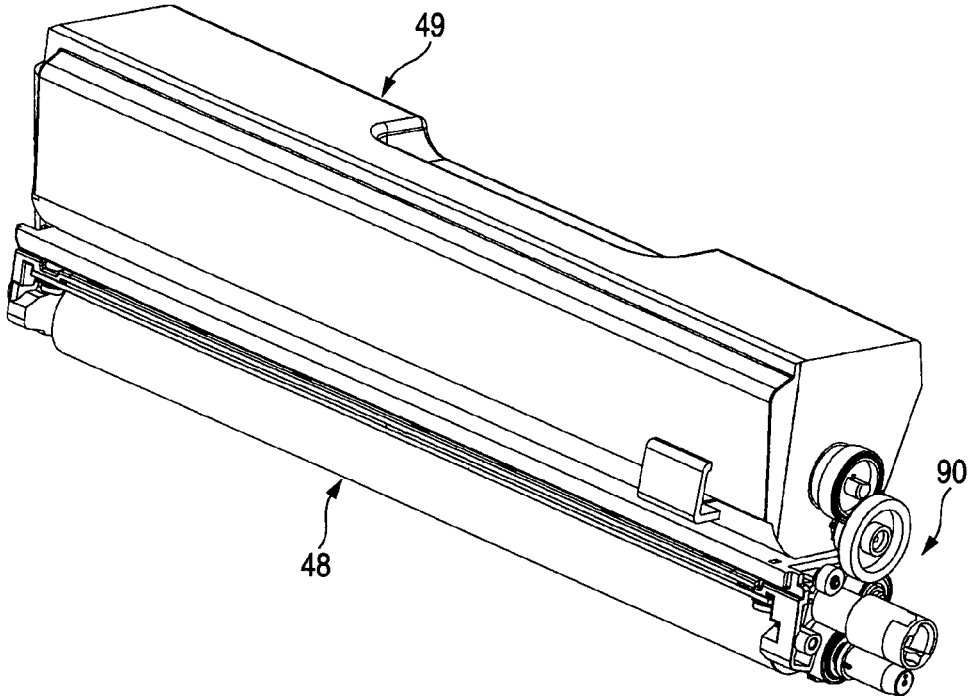
FIG. 8(*a*) is a perspective view showing an external appearance of the developing device made up of the developing agent cartridge and the developing unit which are shown in FIG. 2, and FIG. 8(*b*) is a partially enlarged perspective view showing the other ends of the same cartridge and developing unit.
Figure 8:
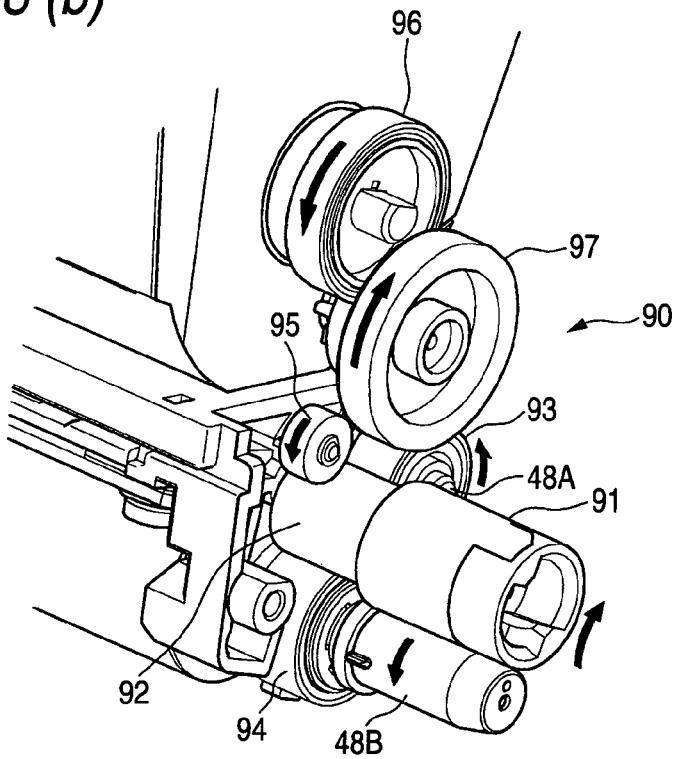

As shown in FIG. 8(*a*), a rotational drive transmission mechanism 90 for driving and rotating the auger 70 and the agitator 60 is provided on side portions of the other ends of the developing unit 48 and the developing agent cartridge 49. This rotational drive transmission mechanism 90 also functions as a rotational drive transmission mechanism for driving and rotating the supplying roller 48A and the developing roller 48B which are located in the developing unit 48 shown in FIG. 1.

As shown in FIG. 8(*b*), a drive gear 92 is formed on an input shaft 91. The drive gear 92 meshes with: a driven gear 93 fixed to the other end portion of the supplying roller 48A; a driven gear 94 fixed to the other end portion of the developing roller 48B; and a driven gear 95 fixed to the other end portion of the auger 70. The driven gear 93 of the supplying roller 48A meshes with a driven gear 96 fixed to the other end portion of the agitator 60 via a reduction gear 97 having two large and small gears.

By the rotational drive transmission mechanism 90, the auger 70 is driven to rotate together with the supplying roller 48A and the developing roller 48B in an opposite direction to the input shaft 91 at increased speeds while the agitator 60 is driven to rotate in the opposite direction to the input shaft 91 at reduced speeds. The rotational driving force is transmitted from the one end portion of the supplying roller 48A to the lower end portion of the auger 80.

In each of the process cartridges 46 forming the process unit 42 of the image forming unit 40 in the color laser printer 1, the developing agent stored within the developing agent storage chamber 49I of the developing agent cartridge 49 passes through the interior of the developing chamber 48H of the developing unit 48 and is then recirculated to the interior of the developing agent storage chamber 49I by the rotation of the input shaft 91.

Namely, the developing agent within the developing agent storage chamber 49I is conveyed from the one end of the developing agent storage chamber 49I to the other end of the developing agent storage chamber 49I by the rotation of the agitator 60 serving as the first conveying unit in the developing agent storage chamber 49I, and the developing agent is then conveyed from the other end of the developing chamber 48H to the one end of the developing chamber 48H by the rotation of the auger 70 serving as the second conveying unit in the developing chamber 48H. Thereafter, the developing agent is surely conveyed for recirculation from the one end of the developing chamber 48H to the one end of the developing agent storage chamber 49I, located above the developing chamber 48H, by the auger 80 serving as the third conveying unit.

Consequently, according to the developing device of the embodiment, the fresh developing agent that is supplied from the developing agent storage chamber 49I into the developing chamber 48H and the non-fresh developing agent that has been in the developing chamber 48H can be mixed together uniformly. That is, the accumulation of the non-fresh developing agent in the developing chamber 48H can be suppressed.

Accordingly, each process cartridge 46 can suppress the adhesion of the deteriorated toner onto the surface of the photosensitive drum 47A from the supplying roller 48A via the developing roller 48B which are located in the developing chamber 48H of the developing unit 48, and can correspondingly increase the quality of the developing agent image formed on the photosensitive drum 47A. Consequently, the image forming unit 40 of the color laser printer 1 can increase the quality of the image formed on the recording sheet SH.

In the embodiment, the third conveying unit is constructed to have the auger 80 which is driven to rotate about the rotational shaft to convey the toner in the direction of the rotational shaft. Accordingly, even in the developing device in which the developing agent storage chamber 49I is disposed above the developing chamber 48H in a gravity direction, the toner can be conveyed in the ensured fashion from the one end of the developing chamber 48H to the one end of the developing agent storage chamber 49I in the direction of the rotational shaft by the rotation of the auger 80.

In the embodiment, the non-magnetic single-component toner is used as the developing agent, and the auger 80 is connected via the bevel gears 82, 83 to the end portion of the supplying roller 48A which is accommodated in the developing chamber 48 and driven to rotate. In case of the developing system utilizing the non-magnetic single-component toner, the toner is considerably deteriorated due to sliding friction. Since charging of the toner is implemented by bringing the toner into sliding friction between the developing roller 48B and the supplying roller 48A or between the developing roller 48B and the layer thickness regulator, the toner on the developing roller 48B is subjected to sliding friction every single rotation of the developing roller 48B to thereby be deteriorated. This has caused the problem that some countermeasures against the deterioration of the toner are to be taken. In the embodiment, even though the non-magnetic single-component toner is used, the toner is circulated between the developing agent storage chamber 49I and the developing chamber 48H. Accordingly, the deterioration of toner can be suppressed, and an improved image can be formed over the entirety of the image forming width.

In particular, in the embodiment, the auger 80 is disposed outside of the image forming width which is specified within the developing chamber 48. Although there is a possibility that the density of toner is decreased due to a reduction in pressure at a lower portion of the auger 80, the auger 80 is disposed outside of the image forming width, and therefore the image formed is prevented from getting too light, which would otherwise be the case due to the adverse effect of the reduced pressure.

In the embodiment, the rotational drive transmission mechanism 90 for the agitator 60 serving as the first conveying unit and the auger 70 serving as the second conveying unit is provided at the other ends, in the width direction, of the developing agent storage chamber 49I and the developing chamber 48H. Accordingly, the rotation drive transmission mechanism 90 can be prevented from interfering with another rotation drive transmission mechanism that includes the bevel gears 82, 83 for the third conveying unit and that is located at the one end. The space can also be used effectively.

In the embodiment, the developing chamber 48H is defined in the developing unit 48, the developing agent storage chamber 49I is defined in the developing agent cartridge 49 which can be detachably attached to the developing unit 48, and the auger 80 serving as the third conveying unit is disposed within the developing agent cartridge 49. Consequently, the auger 80 conveys the toner in such a manner as to scoop up the toner in the developing chamber 48H. In particular, the position where the toner is discharged into the developing agent storage chamber 49I by the auger 80 is upper than the rotational shaft 61 of the agitator 60, and the toner is so discharged by the auger 80 from an upper position than the toner reserved in the developing agent storage chamber 49I. Because of this, compared with a case where toner is pushed up, load exerted on the toner becomes less, and hence the toner is not deteriorated. Further, the toner can be conveyed in a smooth fashion.

Figure 9:
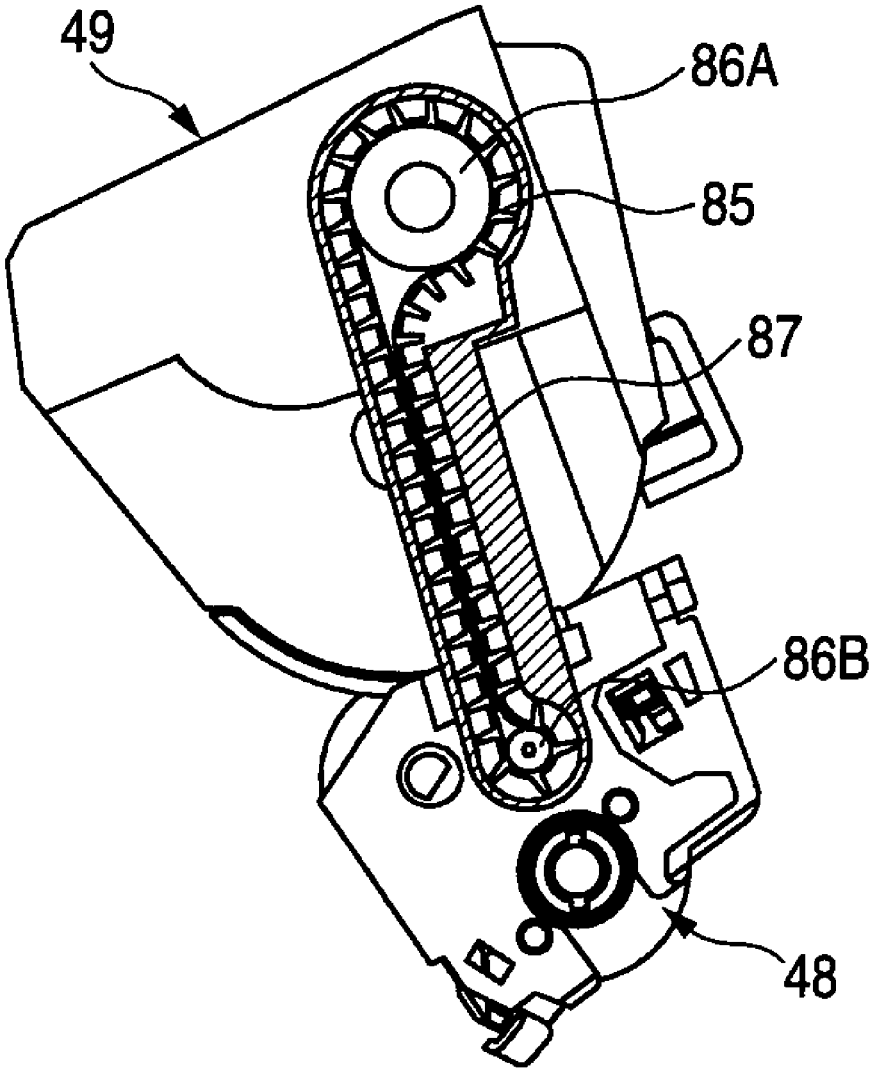
FIG. 9 is a sectioned side view of a developing device showing a modified example in which the auger is changed to a toothed conveyer belt.

The developing device according to the invention is not limited to the embodiment that has been described heretofore. For example, the auger 80 shown in FIG. 6 serving as the third conveying unit may be disposed in the developing chamber 48H of the developing unit 48 outside the image forming width. Further, this auger 80 can be modified to a toothed conveyer belt 85 shown in FIG. 9. In this modification, a drive pulley 86A and a driven pulley 86B are provided on the developing agent cartridge 49, and the toothed conveyer belt 85 is wound between these two pulleys. Further, the periphery of the toothed conveyer belt 85 is surrounded by a housing 87. By driving the drive pulley 86A to rotate in this configuration, the toner can be conveyed from the developing chamber 48H to the developing agent storage chamber 49I.

Further, the respective process cartridges 46 do not have to be aligned in the tandem fashion with the upper portion slightly tilted toward the near side, and the developing agent cartridges 49 and the developing units 48 which make up the developing devices may be arranged adjacent to one another in the conveying direction of the recording sheets SH.

Furthermore, the process cartridge 46 may be a single process cartridge which can be detachably attached to a process unit of a monochrome laser printer or may be attached to a multi-function device or a copying machine.

As discussed above, the present invention can provide at least the following illustrative, non-limiting embodiments:

(1) A developing device which includes: a developing chamber having one end and another end opposite to the one end in a width direction; a developing agent storage chamber disposed above the developing chamber in a gravity direction, the developing agent storage chamber having one end and another end opposite to the one end of the developing agent storage chamber in the width direction; a partition wall partitioning the developing chamber and the developing agent storage chamber; a developing agent carrier disposed within the developing chamber; a first conveying unit that is provided within the developing agent storage chamber and that is configured to convey a developing agent from the one end of the developing agent storage chamber to the other end of the developing agent storage chamber and to supply the developing agent from the developing agent storage chamber to the developing chamber; a second conveying unit that is provided within the developing chamber and that is configured to convey the developing agent from the other end of the developing chamber to the one end of the developing chamber and to supply the developing agent toward the developing agent carrier; and a third conveying unit that is provided between the one end of the developing agent storage chamber and the one end of the developing chamber and that is configured to convey the developing agent from the one end of the developing chamber to the one end of the developing agent storage chamber.

In the developing device according to (1), the developing agent stored within the developing agent storage chamber is conveyed by the first conveying unit disposed within the developing agent storage chamber from the one end of the developing agent storage chamber to the other end of the developing agent storage chamber and is thereafter supplied from the developing agent storage chamber to the other end of the developing chamber. Then, the developing agent which has been supplied to the other end of the developing chamber is conveyed by the second conveying unit disposed within the developing chamber from the other end of the developing chamber to the one end of the developing chamber and is also supplied toward the developing agent carrier disposed within the developing chamber. Thereafter, the developing agent which has been conveyed to the one end of the developing chamber is conveyed to the one end of the developing agent storage chamber disposed above the developing chamber in the gravity direction by the third conveying unit provided between the developing agent storage chamber and the developing chamber.

Namely, by the developing device according to (1), the developing agent stored in the developing agent storage chamber is conveyed from the one end of the developing agent storage chamber to the other end of the developing agent storage chamber and is then conveyed from the other end of the developing chamber to the one end of the developing chamber. Thereafter, the developing agent is conveyed from the one end of the developing chamber to the one end of the developing agent storage chamber. Accordingly, the developing agent is circulated within the developing agent storage chamber and the developing chamber. Consequently, a fresh developing agent which is to be supplied from the developing agent storage chamber into the developing chamber is mixed uniformly with the non-fresh developing agent which has been in the developing chamber, whereby the accumulation of the non-fresh developing agent within the developing chamber can be prevented and the developing agent can be supplied well over the overall width of the developing agent carrier.

(2) A process cartridge which includes: the developing device as discussed above; and a photosensitive element on which a developing agent image is formed by the developing agent supplied from the developing agent carrier.

In the process cartridge according to (2), since the accumulation of the non-fresh developing agent within the developing chamber of the developing device is suppressed, the quality of the developing agent image formed on the photosensitive element is increased.

(3) A tandem-type image forming apparatus which includes: plural developing devices, each of which is configured as discussed above, wherein the plural developing devices are aligned in a conveying direction of a recording sheet on which an image is to be formed.

In the image forming apparatus according to (3), since the accumulation of the non-fresh developing agent within the developing chamber of the developing device is suppressed, the quality of the developing agent image formed on the photosensitive element is increased and as a result of this, the quality of the image formed on the recording sheet is increased.

What is claimed is:

1. A developing device comprising:

a developing chamber in which a developing agent carrier is disposed, the developing chamber having one end and another end opposite to the one end in a longitudinal direction of the developing agent carrier;

a developing agent storage chamber disposed above the developing chamber in a gravity direction, the developing agent storage chamber having one end and another end opposite to the one end of the developing agent storage chamber in the longitudinal direction;

a partition wall partitioning the developing chamber and the developing agent storage chamber;

a first conveying unit that is provided within the developing agent storage chamber and that is configured to convey a developing agent from the one end of the developing agent storage chamber to the other end of the developing agent storage chamber and to supply the developing agent from the developing agent storage chamber to the developing chamber;

a second conveying unit that is provided within the developing chamber and that is configured to convey the developing agent from the other end of the developing chamber to the one end of the developing chamber and to supply the developing agent toward the developing agent carrier; and a third conveying unit that is provided between the one end of the developing agent storage chamber and the one end of the developing chamber and that is configured to convey the developing agent from the one end of the developing chamber to the one end of the developing agent storage chamber, wherein the third conveying unit is disposed to be directly opposed to one end of the second conveying unit in a developing agent conveying direction of the second conveying unit, and the developing agent conveying direction of the second conveying unit is perpendicular to a developing agent conveying direction of the third conveying unit.

2. The developing device as set forth in claim 1, wherein the third conveying unit has an auger driven to rotate about a rotational axis for conveying the developing agent in a direction of the rotational axis.

3. The developing device as set forth in claim 2, wherein:

a non-magnetic single-component developing agent is stored as the developing agent in the developing agent storage chamber;

a developing agent supplying member driven to rotate is disposed in the developing chamber; and the auger is connected to an end portion of the developing agent supplying member via bevel gears.

4. The developing device as set forth in claim 2, wherein the auger is disposed outside of an image forming width specified within the developing chamber.

5. The developing device as set forth in claim 1, further comprising:

a rotational drive transmission mechanism for the first and second conveying units, which is at the other ends of the developing agent storage chamber and the developing chamber.

6. The developing device as set forth in claim 1, wherein the developing chamber is defined within a developing unit, and the developing agent storage chamber is defined within a developing agent cartridge which is configured to be detachably attached to the developing unit, and the third conveying unit is disposed within the developing agent cartridge.

7. A process cartridge comprising:

a developing device including:

a developing chamber in which a developing agent carrier is disposed, the developing chamber having one end and another end opposite to the one end in a longitudinal direction of the developing agent carrier;

a developing agent storage chamber disposed above the developing chamber in a gravity direction, the developing agent storage chamber having one end and another end opposite to the one end of the developing agent storage chamber in the longitudinal direction;

a partition wall partitioning the developing chamber and the developing agent storage chamber;

a first conveying unit that is provided within the developing agent storage chamber and that is configured to convey a developing agent from the one end of the developing agent storage chamber to the other end of the developing agent storage chamber and to supply the developing agent from the developing agent storage chamber to the developing chamber;

a second conveying unit that is provided within the developing chamber and that is configured to convey the developing agent from the other end of the developing chamber to the one end of the developing chamber and to supply the developing agent toward the developing agent carrier; and a third conveying unit that is provided between the one end of the developing agent storage chamber and the one end of the developing chamber and that is configured to convey the developing agent from the one end of the developing chamber to the one end of the developing agent storage chamber, wherein the third conveying unit is disposed to be directly opposed to one end of the second conveying unit in a developing agent conveying direction of the second conveying unit, and the developing agent conveying direction of the second conveying unit is perpendicular to a developing agent conveying direction of the third conveying unit; and a photosensitive element on which a developing agent image is formed by the developing agent supplied from the developing agent carrier.

8. A tandem-type image forming apparatus comprising:

plural developing devices, each including a developing chamber in which a developing agent carrier is disposed, the developing chamber having one end and another end opposite to the one end in a longitudinal direction of the developing agent carrier;

a developing agent storage chamber disposed above the developing chamber in a gravity direction, the developing agent storage chamber having one end and another end opposite to the one end of the developing agent storage chamber in the longitudinal direction;

a partition wall partitioning the developing chamber and the developing agent storage chamber;

a first conveying unit that is provided within the developing agent storage chamber and that is configured to convey a developing agent from the one end of the developing agent storage chamber to the other end of the developing agent storage chamber and to supply the developing agent from the developing agent storage chamber to the developing chamber;

a second conveying unit that is provided within the developing chamber and that is configured to convey the developing agent from the other end of the developing chamber to the one end of the developing chamber and to supply the developing agent toward the developing agent carrier; and a third conveying unit that is provided between the one end of the developing agent storage chamber and the one end of the developing chamber and that is configured to convey the developing agent from the one end of the developing chamber to the one end of the developing agent storage chamber, wherein the third conveying unit is disposed to be directly opposed to one end of the second conveying unit in a developing agent conveying direction of the second conveying unit, and the developing agent conveying direction of the second conveying unit is perpendicular to a developing agent conveying direction of the third conveying unit, and wherein the plural developing devices are aligned in a conveying direction of a recording sheet on which an image is to be formed.

9. The developing device as set forth in claim 1, wherein the developing agent carrier is a developing roller, the longitudinal direction is an axial direction of the developing roller.

10. The developing device as set forth in claim 1, wherein an opening of the third conveying unit is disposed to be opposed to an opening of the second conveying unit.

* * * * *